United States Patent [19]

Kinsey

[11] Patent Number: 4,585,169

[45] Date of Patent: Apr. 29, 1986

[54] CONSTANT VOLUME FLOW BURNER FUEL CONTROL SYSTEM

[75] Inventor: Joseph B. Kinsey, Harrisonburg, Va.

[73] Assignee: Dunham-Bush, Inc., West Hartford, Conn.

[21] Appl. No.: 384,294

[22] Filed: Jun. 2, 1982

[51] Int. Cl.[4] ..... F04B 23/04; F04B 49/00; F04D 15/00

[52] U.S. Cl. ..... 239/75; 137/115; 137/566; 239/126

[58] Field of Search ..... 239/75, 126, 127, 125; 137/115, 566

[56] References Cited

U.S. PATENT DOCUMENTS

| | | | |
|---|---|---|---|
| 2,006,865 | 7/1935 | Lake | 137/566 |
| 2,537,681 | 1/1951 | Lawrence | 239/125 |
| 2,859,806 | 11/1958 | Lake et al. | 239/75 |
| 3,515,164 | 6/1970 | Dunnous | 137/566 |

*Primary Examiner*—Andres Kashnikow
*Attorney, Agent, or Firm*—Sughrue, Mion, Zinn, Macpeak and Seas

[57] ABSTRACT

A pair of positive displacement pumps are connected in series between a liquid fuel supply tank and a burner nozzle. Mechanically linked, identical variable orifices are interposed within the supply line between the pumps and the nozzle. A first pressure regulator is connected across the supply line between the pumps and a return line leading from the nozzle back to the supply tank. A pressure sensing line for the first pressure regulator is connected to the supply line on the discharge side of the second positive displacement pump to regulate the outlet pressure of the first pump. The discharge line for one of the variable orifices leads to the burner nozzle and forms part of the supply line, while the discharge line for the other variable orifice bears a second pressure regulator and connects to the return line. A pressure sensing line for the second pressure regulator is connected to the supply line, downstream of the one variable orifice, to insure that the pressure differentials across both variable orifices are identical and that the percentage flow through the one variable orifice and the other variable orifice will remain the same at any given setting. Since the flow from the second positive displacement pump is constant regardless of viscosity and since the flow through the one variable orifice is a fixed percentage of the flow, the flow to the nozzle is limited and fixed regardless of viscosity of the liquid fuel.

2 Claims, 3 Drawing Figures

CONSTANT VOLUME FLOW BURNER FUEL CONTROL SYSTEM

FIELD OF THE INVENTION

This invention relates to liquid fuel burner control systems and more particularly to a system supplying a given volume of fuel oil to the nozzle of a burner irrespective of the viscosity of the fuel supply thereto.

Oil burner systems require the metering of the flow of oil to the burner nozzle. Such systems are designed to provide constant volume flow upon setting of the system, however flow rate or volume changes in response to viscosity change of the fuel oil. Attempts have been made to insure that the flow volume or rate remains constant irrespective of oil viscosity. In one such system, oil is drawn from a flooded reservoir by means of a secondary pump with the primary pump feeding oil to that reservoir. Such systems only assure that the suction pressure of the secondary pump is positive. Also, all positive displacement pumps have clearances, particularly gear pumps which affect the flow to the pump dependent upon pressure drop and viscosity.

A viscosity compensation burner control system is the subject of U.S. Pat. No. 3,972,351 issuing Aug. 3, 1976. In that burner control system a housing, functioning as a reservoir, houses primary and secondary gear type positive displacement pumps which are conduit connected from a supply tank and which leads to the burner nozzle. The system is characterized by the presence of a back pressure valve within the line leading from the primary pump to the inlet of the secondary pump to substantially equalize the oil pressure between the inlet and outlet sides of the secondary pump and which functions to discharge the excess oil capacity back into the reservoir. The system is also characterized by a first pressure relief valve within the discharge line from the secondary pump leading to the nozzle burner to relieve excess pressure on the discharge side of the secondary pump. A further pressure relief valve is provided in the line downstream of a pressure balance valve 32 functioning to equalize the pressure drop through two tapered viscosity passages, one leading to the burner nozzle and the other back to the reservoir.

While the oil burner control system of that patent tends to insure constant volume flow of the fuel to the burner nozzle, even when lighter viscosity liquid fuels are supplied to the system, the control system is complicated, and it requires the presence of a reservoir.

It is a primary object of the present invention to provide an improved, simplified constant volume oil burner system to ensure, irrespective of fuel oil viscosity change, that the inlet and discharge pressure for a second positive displacement pump feeding oil to the burner nozzle has equal inlet and discharge pressure.

It is a further object of the present invention to provide such an improved system wherein an identical pair of variable orifices are provided within a liquid fuel supply line intermediate of paired first and second positive displacement pumps and the nozzle, and wherein the discharge line for one of the variable orifices feeds directly to the nozzle, the discharge line for the other variable orifice feeds to a fuel oil return line from the nozzle back to the supply tank and bears a pressure regulator controlled by a pressure sensing line opening to the supply line intermediate of the first variable orifice discharge line and the burner nozzle, and wherein a further pressure regulator is connected across the supply and return lines intermediate of the positive displacement pumps and has a pressure sensing line opening to the supply line on the discharge side of the second positive displacement pump.

SUMMARY OF THE INVENTION

The present invention is directed to a burner control system for insuring constant volume flow of liquid fuel to a burner nozzle irrespective of the viscosity of the liquid fuel. The system comprises a fuel supply tank bearing a liquid fuel and a burner nozzle fuel supply line connecting the tank to a burner nozzle. A separate fuel return line connects the burner nozzle back to the tank for returning excess fuel thereto. First and second positive displacement fuel pumps, such as gear pumps, are connected in series and in order within the fuel supply line between the fuel supply tank and the nozzle. The fuel supply line branches downstream of the second fuel pump and identical, first and second orifices are provided within said branch lines respectively. One of the variable orifices has its outlet connected to the supply line upstream of the nozzle while the other of said orifices has its outlet connected to the return line. A first pressure regulator is connected between the supply line and the return line intermediate of the first and second pumps and has a pressure sensing line for controlling flow through the first pressure regulator connected to the supply line downstream of the second positive displacement pump. A second pressure regulator is connected within the discharge line of the other variable orifice connecting to the return line and the second pressure regulator has a pressure sensing line for controlling flow through the second pressure regulator connected to the discharge line of the first variable orifice upstream of the burner. Means are provided for operatively connecting the variable orifices such that as one variable orifice opens the other closes, and vice versa. Thus, the discharge pressure of the second variable orifice is controlled by the second pressure regulator so that the pressure differential across both orifices are identical to insure the percentage flow through the first variable orifice and the percentage flow through the second variable orifice remain the same at any given setting. Further, with the discharge pressure from the first positive displacement pump being controlled by the first pressure regulator to maintain essentially zero pressure differential across the second positive displacement pump, this eliminates any flow variations caused by slip in the pump as viscosity changes and constant volume flow through the paired variable orifices. With the flow through the first variable orifice being a fixed percentage of the flow, the flow to the nozzle is limited and fixed irrespective of viscosity. The variable orifices may each include a control rod for varying the orifice opening size and the system further includes means for mechanically linking the rods together.

DESCRIPTION OF THE PREFERRED EMBODIMENT

Figure 3:
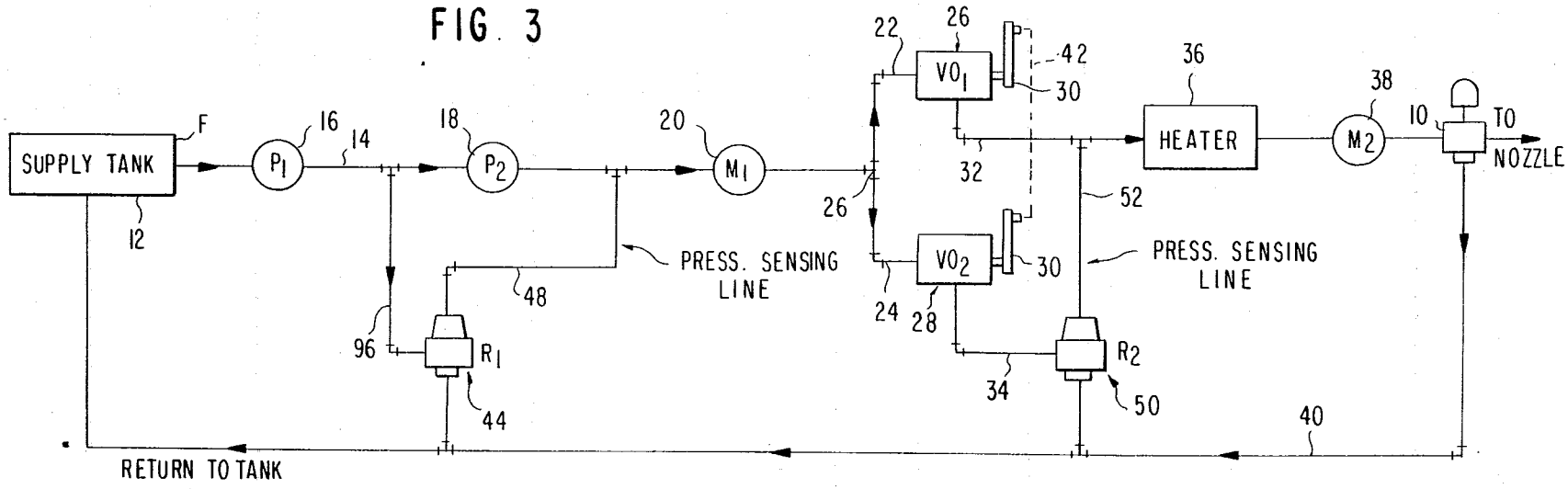
FIG. 3 is a schematic diagram of a preferred embodiment of the constant volume flow burner fuel control system of the present invention.

Prior to describing the embodiment of te present invention in detail as illustrated in FIG. 3, it is believed helpful to understand the principles upon which the operation of the constant volume flow burner fuel control system of the present invention is based. In that respect, turning to FIG. 1, it may be seen that in the elementary system, flow is divided or split into two flows Q1, Q2 for total flow (Qin). Thus:

$$Qn = Q1 + Q2. \quad (1)$$

The laws of incompressible, viscous fluid flow require that flow (Q) be a function of area (A), pressure differential (ΔP) specific gravity (Sg) and viscosity (μ). The relationship is:

$$Q = (f)\frac{\Delta P}{Sg\mu} A \quad (2)$$

Figure 1:
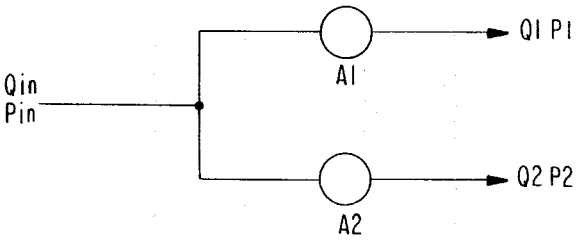
FIG. 1 is a schematic representation of certain elements of the constant volume flow burner fuel control system of the present invention illustrating the principle upon which the invention is based.

Regarding FIG. 1, therefore, the relations for the elementary system are as follows:

$$\Delta P1 = Pin - P1 \quad (3)$$

$$\Delta P2 = Pin - P2 \quad (4)$$

$$Q1 = (f)\frac{Pin - P1}{Sg_1\,\mu_1} \times A1 \quad (5)$$

$$Q2 = (f)\frac{Pin - P2}{Sg_2\,\mu_2} \times A2 \quad (6)$$

where A1 and A2 are the areas of the two orifices in the system, therefore:

$$\frac{Q1}{Q2} = \frac{Pin - P1}{Pin - P2} \times \frac{Sg_2\,\mu_2}{Sg_1\,\mu_1} \times \frac{A1}{A2} \quad (7)$$

Since the same fluid is flowing through both orifices, the specific gravity and viscosity are the same, and therefore that term is equal to 1 and may be dropped from the relation. Simplifying, then:

$$\frac{Q1}{Q2} = \frac{Pin - P1}{Pin - P2} \times \frac{A1}{A2} \quad (8)$$

The present invention proposes to introduce a device in the system to closely regulate pressure P2 so that it is equal to P1, the pressure term in the equation 7 above becomes unity and the proportionate flow is dependent only on the ratio of the area of the orifices. Thus, $$\frac{Q1}{Q2} = \frac{A1}{A2} \quad (9)$$

Figure 2:
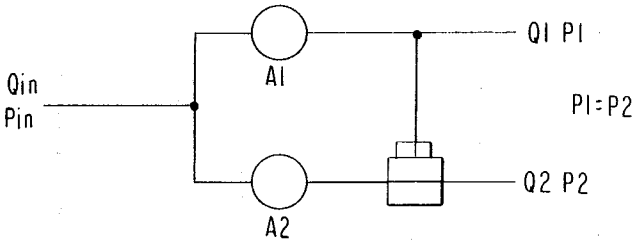
FIG. 2 is a schematic diagram similar to FIG. 1, further incorporating a pressure regulator which forms a principal component of the constant volume flow burner fuel control system of the present invention.

Referring to FIG. 2, it then follows that:

If the total flow (Qin) is kept constant and the proportion is constant, the flow through either orifice will be the same irrespective of the fluid flowing in the system.

As a preferred embodiment, applicant's system, FIG. 3, functions to supply a given volume of fuel oil to a nozzle indicated at 10 of a fuel burner (not shown) bearing said nozzle, irrespective of the viscosity of a liquid hydrocarbon fuel F supplied to the device from a supply tank 12. The constant volume flow burner fuel control system of FIG. 3 utilizes a supply conduit or line 14 leading from the supply tank 12 towards nozzle 10 and having incorporated therein a pair of positive displacement pumps comprising a first pump 16 and a second pump 18, in series, and in order from the supply tank 12. The positive displacement pumps 16 and 18 may be gear pumps. As may be appreciated, the oil from the first positive displacement gear pump 16 is delivered directly to the second positive displacement gear pump 18. Within the supply line 14, downstream of the secondary pump 18, is a flow meter as at 20, and downstream from the flow meter 20, the supply line 16 branches into branch line 22 and 24, respectively, at point 26. Within branch lines 22 and 24, are provided respectively, identical first and second variable orifices indicated generally at 26 and 28. The variable orifices 26 and 28 are of standard commercial manufacture and are of a type employing control rods as at 30 for controlling the size of the variable orifice openings leading to variable orifice discharge lines 32 and 34, respectively, for variable orifices 26 and 28. Variable orifice discharge line 32 forms a continuation of supply line 14 and leads to nozzle 10. Within line 32 is incorporated a heater as at 36 and a flow meter as at 38. Further, a return line or conduit 40 connects to the nozzle 10 at one end and connects at its opposite end to the supply tank 12, thereby functioning to return excess oil from the nozzle 10 back to the supply tank.

As may be appreciated, the control rods 30 for the variable orifices 26 and 28 are mechanically linked, as indicated by dotted line 42 by control means such that, as one orifice opens, the other closes and vice versa. Further, the control means may be limited by a mechanical stop (not shown) at any maximum flow rate required at nozzle 10.

Important to the present invention and in line with the analysis above establishing the principles for the operation of the constant volume flow system of the present invention, there are required two pressure regulators to insure constant volume flow irrespective of viscosity change of the fuel (F) within the supply tank 12. In that respect, a first pressure regulator indicated generally at 44, is mounted within a bypass line 46 which is connected between supply line 14 and return line 40, being connected to supply line 14 at a point intermediate of the primary positive displacement pump 16 and secondary positive displacement pump 18. Further, the pressure regulator 44 is provided with a pressure sensing line as at 48 which is connected to the supply line 14 downstream of the secondary positive displacement pump 18. By sensing the pressure within line 14 on the discharge side of the secondary positive displacement pump 18, the discharge pressure from the first displacement pump 16 is controlled by the pressure regulator 44 in accordance with the second pump discharge pressure. The control is set to maintain essentially zero pressure differential across the second positive displacement pump 18 and to eliminate any flow variations caused by slip in the second positive displacement pump 18 as viscosity of the fuel F changes. This allows a constant volume fuel flow to branch lines 22 and 24 bearing the identical variable orifices 26 and 28.

As a second aspect of the present invention, there is provided a second pressure regulator 50 which is interposed within the discharge line 34 for the second variable orifice 28 leading to return line 40. The second pressure regulator 50 includes a pressure sensing line 52 which is connected to the discharge line 32 for the first variable orifice 26 between that orifice and nozzle 10. As may be appreciated, the discharge pressure of the second variable orifice 28 is controlled by pressure regulator 50 so that the pressure differential across both variable orifices 26 and 28 are identical. This insures that the percentage flow of fuel through the first variable orifice 26 and the percentage flow of fuel through the second variable orifice 28 remain the same for any given setting provided by linkage 42 to control rods 30 for these variable orifices. By the use of the pressure regulators whose pressure sensing lines are downstream of the second positive displacement pump 18 and the first variable orifice 26, respectively, and which functions to control the discharge pressure of the first positive displacement pump and the discharge pressure of the second variable orifice, the result is the maintenance of constant volume fuel flow to the burner nozzle 10 irrespective of fuel viscosity. Since the flow of fuel from the second positive displacement pump 18 is constant regardless of viscosity and the flow through the first variable orifice 26 is a fixed percentage of this flow, the flow to the nozzle 10 is limited corresponding to the setting effected by linkage or mechanism 42 and fixed irrespective of viscosity.

While the invention has been particularly shown and described with reference to a preferred embodiment thereof, it will be understood by those skilled in the art that various changes in form and details may be made therein without departing from the spirit and scope of the invention.

What is claimed is:

1. A burner control system for insuring constant volume flow of liquid fuel, irrespective of viscosity changes for said fuel, said system comprising:

a fuel supply tank bearing liquid fuel, a burner nozzle, a burner nozzle fuel supply line connecting said tank to said nozzle, a fuel return line connecting said nozzle back to said tank for returning excess fuel, first and second positive displacement fuel pumps in series and in order within said fuel supply line, branch lines within said fuel supply line downstream of said second fuel pump, separate, identical first and second variable orifices separately positioned within said branch lines, respectively, each varaible orifice having an inlet connected to a respective branch line, said first orifice having an outlet connected to said nozzle and said second orifice having an outlet connected to said return line, means responsive to the pressure at the discharge side of said second pump for controlling the discharge pressure of said first pump, means responsive to the discharge pressure of said first variable orifice for controlling the discharge pressure of said second variable orifice, and means for mechanically linking said separate variable orifices for controlling said variable orifices such that as one opens the other closes;

and wherein each of said variable orifices includes a control rod for varying the opening size of each orifice, and said means mechanically linking said separate variable orifices comprises a means for mechanically linking said rods to variably position said control rods such that as one orifice opens, the other closes, and vice versa;

whereby, the control of the discharge pressure from said first pump maintains essentially zero pressure differential across said second pump to eliminate any flow variations caused by slip in the pump as viscosity changes, and the control of the discharge pressure of said second variable orifice is such that the pressure differential across both variable orifices are identical to insure that the percentage flow through respective variable orifices remains the same, thereby maintaining fuel flow through the nozzle limited and fixed regardless of the viscosity of the liquid fuel.

2. The burner control system as claimed in claim 1, wherein said means responsive to the pressure at the discharge side of said second pump for controlling the discharge pressure of said first pump comprises a pressure regulator connected across the supply and return lines downstream of the first pump, and wherein said pressure regulator comprises a pressure sensing line for operatively controlling said pressure regulator and being connected to said supply line at the discharge side of said second pump, said second variable orifice comprises a discharge line connected to the return line downstream of said nozzle, and wherein said means responsive to the discharge pressure of said first variable orifice for controlling the discharge pressure of said second variable orifice comprises a pressure regulator within said second variable orifice discharge line, said second pressure regulator including a pressure sensing line for controlling said second pressure regulator and being connected to the discharge line of said first variable orifice, upstream of said nozzle.

* * * * *